United States Patent [19]

Siverson

[11] 4,161,902

[45] Jul. 24, 1979

[54] JEW'S HARP

[76] Inventor: Harry E. Siverson, 4805 SE. 26th Ave., Portland, Oreg. 97202

[21] Appl. No.: 915,975

[22] Filed: Jun. 16, 1978

[51] Int. Cl.[2] ..... G10D 7/12

[52] U.S. Cl. ..... 84/375

[58] Field of Search ..... 84/375, 408

[56] References Cited

U.S. PATENT DOCUMENTS

| | | | |
|---|---|---|---|
| 1,044,025 | 11/1912 | Combs | 84/375 |
| 1,266,556 | 5/1918 | Cook | 84/375 |
| 4,000,677 | 1/1977 | Rabb | 84/375 |

*Primary Examiner*—Lawrence R. Franklin
*Attorney, Agent, or Firm*—Eugene M. Eckelman

[57] ABSTRACT

A pair of arms extending from a closed looped end of the frame are flexed toward each other and have apertures at their free ends to receive a spacer pin having opposite ends removably engaged in such apertures. The pin has lateral abutment at these apertures to provide selected spacing of the arms and maintain them out of contact with a reed extending from the looped end. The base end of the reed seats in a shallow groove and is clamped for longitudinal and lateral adjustment by a removable clamp plate.

13 Claims, 8 Drawing Figures

JEW'S HARP

BACKGROUND OF THE INVENTION

This invention relates to new and useful improvements in Jew's-Harps.

Jew's-Harps have long been known as a musical instrument and are becoming increasingly popular. These instruments if properly manufactured and tuned can produce a widened range of pleasant tones. Prior devices have been produced in mass and since they have no built-in means for adjusting the reed and frame relationship or the frame shape, the instrument must be distorted or bent by hand to accomplish such adjustment. This is a very expensive process of tuning for the manufacturer and thus to mass produce the harps and to make them inexpensive, they are supplied direct without adjustment. While still being able to produce acceptable tones they nevertheless are not of the high quality, predictable tone desired by some musicians.

Furthermore, when a Jew's-Harp is being played, the musician may accidentally flex the arms of the frame. One or both of the arms may thus interfere with the operation of the reed. In an attempt to overcome this problem prior devices have bridged the frame or arms together. The bridge construction in some prior devices, however, still allows some flexing of the arms and in others the bridging provides such a built-in rigid structure that there can be no appreciable variance in assembly.

Prior devices thus fail to produce an instrument that has a high quality, predictable tone but at the same time can be mass produced by machine.

SUMMARY OF THE INVENTION

According to the present invention and forming a primary objective thereof, a Jew's-Harp construction is provided which can be mass produced by machine and at the same time which is of a high quality, predictable tone or which can be readily adjusted to such a tone.

Objectives of the invention are accomplished by a construction employing arms which in the manufactured condition of the body portion of the instrument flex toward each other closer than their playing position. A spacer pin engaged in apertures at the end portions of the arms has lateral abutment to selectively hold and position the arms in the desired spacing for the operation of a reed therebetween. The base end of the reed seats in a shallow and widened groove at the loop end of the frame and is clamped for longitudinal and lateral adjustment by a removable clamp plate. The invention will be better understood and additional objects and advantages will become apparent from the following description taken in connection with the accompanying drawings.

DETAILED DESCRIPTION OF PREFERRED EMBODIMENTS

Figure 3:
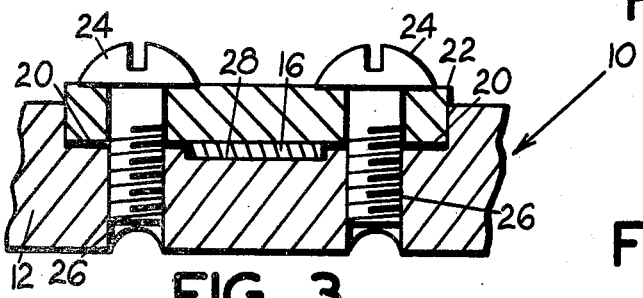
FIG. 3 is an enlarged fragmentary sectional view taken on the line 3—3 of FIG. 1.
Figure 4:
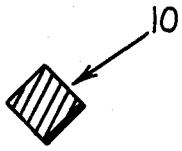
FIG. 4 is a sectional view taken on the line 4—4 of FIG. 1.

With particular reference to the drawings and first to FIGS. 1–4, the present Jew's-Harp comprises a frame 10 having the usual looped end portion 12 and projecting arms 14. The frame in cross section is of a conventional diamond-shape as seen in FIG. 4.

A reed 16 is attached at its base end to the looped end 12 of the frame and extends between the arms 14 to produce tones when stroked by the musician. The free end of the reed 16 has an angled finger engaging portion 18.

The looped end 12 of the frame has a recess 20, best seen in FIG. 3, which is transverse to the direction of reed 16 and which is arranged freely and removably to receive a clamp plate 22. This plate is connected to the frame by a pair of screws 24 threadedly engaged with tapped bores 26 in such frame.

An auxiliary groove 28 is provided in the bottom of groove 20. Groove 28 extends fully from front to rear of groove 20 and receives the base end of reed 16. This auxiliary groove is of less depth than the thickness of reed 16 but is slightly wider than said reed. By such arrangement, the reed is held securely in place when the clamp plate 22 is tightly screwed down but on the other hand the reed can be adjusted longitudinally or adjusted laterally upon loosening of such clamp plate. Selected positioning of the reed in spaced relation between the arms 14 and its longitudinal positioning can thus readily be accomplished.

Figure 1:
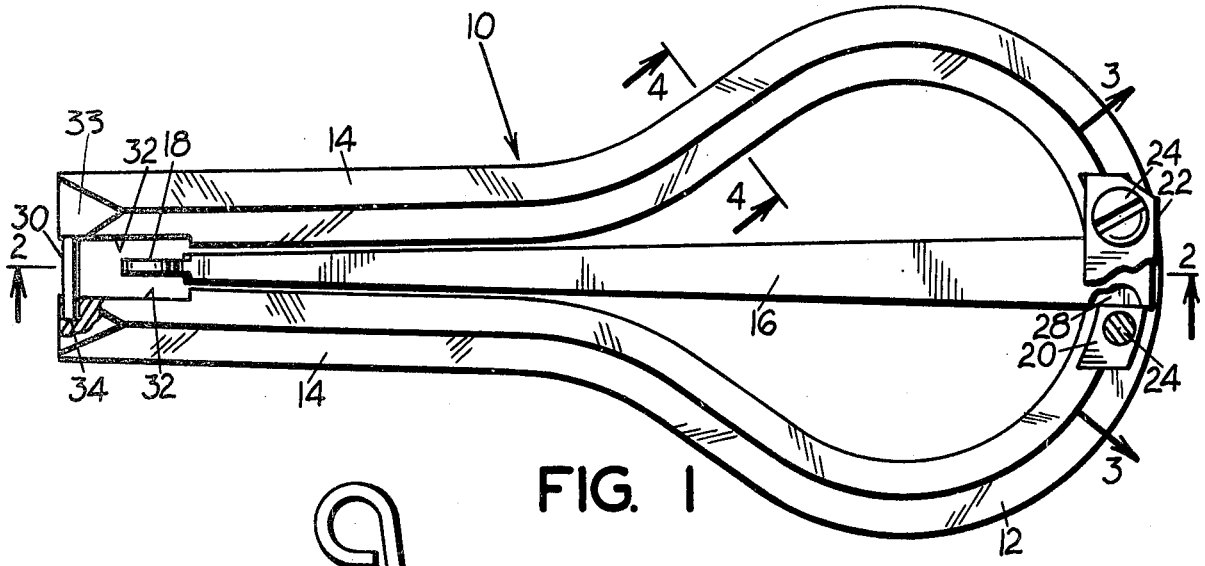
FIG. 1 is a plan view of a Jew's-harp embodying principles of the present invention, this view being partly broken away for clarity.
Figure 2:
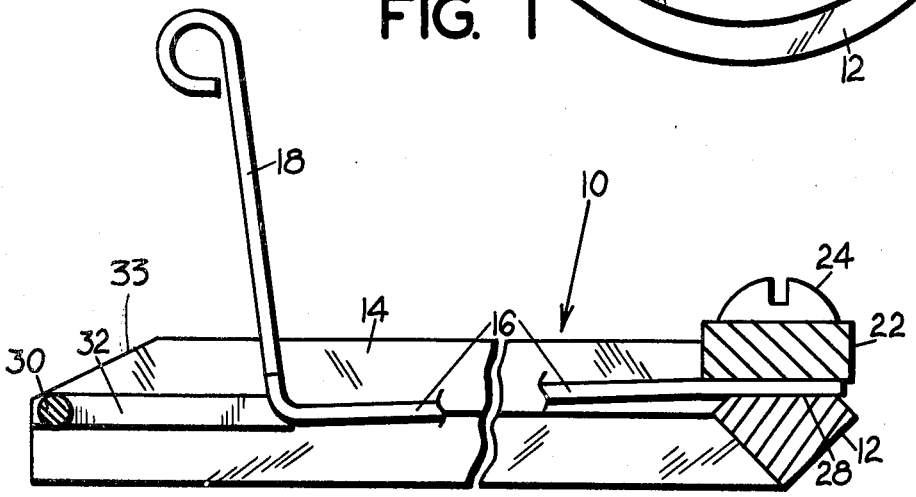
FIG. 2 is an enlarged foreshortened longitudinal sectional view taken on the line 2—2 of FIG. 1.

The construction of the present frame 10 is such that its arms 14 are positioned closer together than they will be in the playing position of the instrument. In order to position the arms to the playing position, a spacer pin 30 is installed at the free ends of the arms. In the embodiment of FIG. 1, the inward facing portions of the arms 14 adjacent the ends thereof have cut away flattened portions 32, and opposed apertures 34 in said flattened portions receive the pin 30. Pin 30 has lateral abutment in the bottoms of apertures 34 and is of a pre-determined length such that when installed the arms are selectively spaced. The pin is held in place simply by the inward springing force of the arms 14 and is installed by flexing the arms 14 apart sufficient to insert it in the apertures.

Arms 14 are of a selected length to provide the necessary tone quality of the instrument and yet allow room for the pin beyond the end of the reed. Flattened portions 32 on the arms provide extra clearance for movement of the angled portion 18 of the reed. The ends of arms 14 on the side from which the finger engaging portion 18 projects are provided with an angle or chamfer 33 to allow good clearance for finger movement in striking said finger engaging portion.

In the manufacture of the present instrument, the frame 10 can be stamped or otherwise machine formed in mass production, the arms 14 as stated above being spaced closer together in such manufacture than the necessary spacing relative to the reed 16 and the pin later installed. The pin can be installed by the manufacturer or by the consumer and the same is true of the reed 16. In the installation of the latter, it is merely adjusted selectively in a longitudinal position as well as a lateral position while the clamp plate 22 is loosened and then fixed in such position by tightening the clamp plate.

Since the pin 30 has lateral abutment with both arms 14, spacing of the arms assumes a definite dimension. In addition, the spacing can readily be varied by substituting pins of varying length. It is thus apparent that fast and precise adjustment of the instrument can be accomplished to not only satisfy the requirements of the consumer but also to adjust for any tolerance defects in manufacture.

Figure 5:
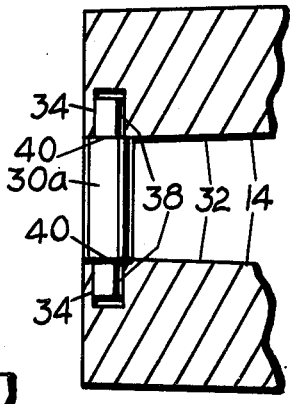
FIGS. 5, 6, 7 and 8 are enlarged fragmentary sectional views showing different forms of spacer means for the arms of the instrument.

FIGS. 5 through 8 show different forms of spacer pins. In FIG. 5, the apertures 34 are the same as in FIG. 1 but the spacer pin **30*a* has reduced end portions 38 which fit in the apertures 34 and which form shoulders 40 that provide the lateral abutment with the arms 14. Reduced end portions 38 are preferably freely received in apertures 34** for easy installation and removal.

Figure 6:
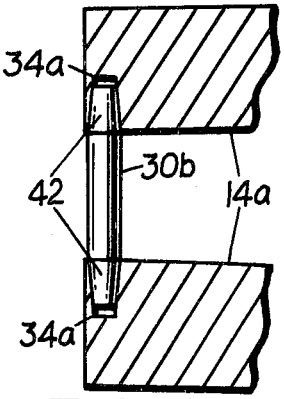

In the embodiment of FIG. 6, the apertures **34*a* in the arms 14*a* are tapered and spacer pin 30*b* has tapered end portions 42 which have wedging engagement with apertures 34*a***.

Figure 7:
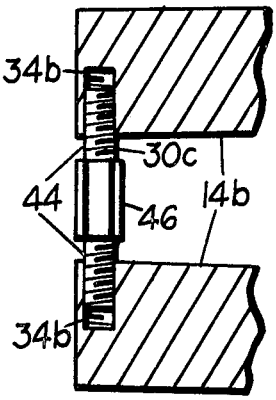

In the embodiment of FIG. 7, the apertures **34*b* are threaded and spacer pin 30*c* has threaded ends 44 which engage such threads. Preferably, the threads in the two apertures as well as the threads on the pin have opposite threads whereby upon rotation of the pin the arms can be spread or brought together. Pin 30*c* has a wrench engaging head 46** for convenient adjustment.

Figure 8:
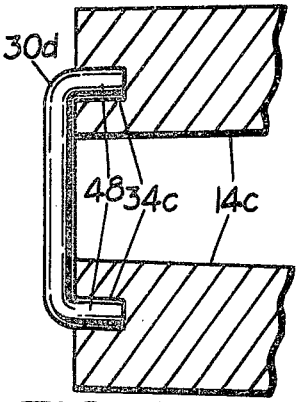

In the embodiment of FIG. 8, the apertures **34*c* are provided in the ends of arms 14*c* and are arranged to receive a spacer pin 30*d* having angled end portions 48 arranged to hook in the apertures. The spacer pin 30*d* is held in place by the outward springing force of arms 14*c* or of course it could be secured by wedging if desired as in FIG. 6** or be adhesively attached.

In addition to providing a Jew's-Harp that can be mass produced by machine and still maintain a high quality of tone, other features are present. For example, the consumer can precisely align the reed through the medium of the clamp plate 22, thus eliminating the present tone damaging procedure now used of distorting the frame to clear the reed. Furthermore, the reed can be adjusted longitudinally to raise or lower the pitch. The spacer means 30 prevents the musician from pinching the arms together and interfering with operation of the reed, and at the same time adjustment can be made by such spacer means in the spacing of the arms.

It is to be understood that the forms of my invention herein shown and described are to be taken as preferred examples of the same and that various changes in the shape, size and arrangement of parts may be resorted to without departing from the spirit of my invention, or the scope of the subjoined claims.

Having thus described my invention, I claim:

1. A Jew's-Harp comprising (a) a frame, (b) said frame having a closed looped end and a pair of arms extending longitudinally from such looped end in spaced relation, (c) said arms having free end portions opposite from said looped end, (d) a reed extending between said arms, (e) means at said looped end of the frame supporting said reed between said arms, (f) and spacer means having opposite ends removably engaged with respective arms, (g) said spacer means having lateral engagement with both of said arms to provide selected spacing of the arms and maintain them out of contact with said reed.

2. The Jew's Harp of claim 1 including apertures in said arms disposed in opposite facing relation for removable engagement by said spacer means.

3. The Jew's-Harp of claim 2 wherein said arms in the formation of said frame are spaced closer together than for their use position and said spacer means hold said arms in an outward flexed position for proper spacing and at the same time are held in said apertures by the inward flexing force of said arms.

4. The Jew's-Harp of claim 2 wherein said apertures and spacer means have threaded engagement.

5. The Jew's-Harp of claim 2 wherein said apertures are tapered inwardly to a smaller dimension and said spacer means are also tapered to have a wedge fit in said apertures.

6. The Jew's Harp of claim 2 wherein said apertures are disposed in said arms in opposed facing relation, said spacer means having reduced end portions projecting into said apertures and also having shoulder portions engageable against said arms.

7. The Jew's-Harp of claim 2 wherein said apertures are provided in the tip ends of said arms.

8. The Jew's-Harp of claim 1 including apertures in said arms disposed in opposed spacing relation for removable engagement by said spacer means, said apertures and spacer means having threaded engagement, the threaded engagement of said spacer means and apertures at opposite ends of said spacer means comprising right and left hand threads whereby said arms can be varied in spacing by rotatable adjustment of said spacer means.

9. The Jew's-Harp of claim 1 including apertures in said arms disposed in opposed spacing relation for removable engagement by said spacer means, said apertures and spacer means having threaded engagement, the threaded engagement of said spacer means and apertures at opposite ends of said spacer means comprising right and left hand threads whereby said arms can be varied in spacing by rotatable adjustment of said spacer means, and a wrench engaging head on said spacer means.

10. The Jew's-Harp of claim 1 wherein said means at said looped end of said frame includes a longitudinal groove in said looped end receiving one end of said reed, said groove being of less depth than the thickness of said reed, and a clamp plate releasably secured on said frame clamping said reed in the groove.

11. The Jew's-Harp of claim 10 wherein said reed is adjustable longitudinally in said groove and is arranged to be clamped in a selective longitudinal position by said clamp plate.

12. The Jew's-Harp of claim 10 wherein said longitudinal groove is wider than said reed and is arranged to be adjusted laterally between said arms and clamped in said adjustable position by said clamp plate.

13. The Jew's-Harp of claim 1 including flat, cut away facing areas in said end portions of said arms allowing end clearance for operation of said reed.

* * * * *